United States Patent [19]

Olsen

[11] Patent Number: 4,540,337

[45] Date of Patent: Sep. 10, 1985

[54] RAM AIR TURBINES

[75] Inventor: Sten O. Olsen, Kongsberg, Norway

[73] Assignee: A/S Kongsberg Vapenfabrikk, Norway

[21] Appl. No.: 492,717

[22] Filed: May 9, 1983

[30] Foreign Application Priority Data

May 10, 1982 [NO] Norway ..... 821533

[51] Int. Cl.[3] ..... F01D 7/02

[52] U.S. Cl. ..... 415/141; 415/25; 416/186 A; 416/45

[58] Field of Search ..... 416/186 A, 186 R, 188, 416/45; 415/140, 141, 13, 36, 25, 82, 156, 2 A, 3 A, 4 A

[56] References Cited

U.S. PATENT DOCUMENTS

| | | | |
|---|---|---|---|
| 147,282 | 2/1874 | Pratt | 415/4 A |
| 1,186,289 | 6/1916 | Dalen | 415/36 X |
| 2,459,815 | 1/1949 | Hammell | 415/36 X |
| 2,766,964 | 10/1956 | Almquist et al. | 415/141 |
| 3,069,137 | 12/1962 | Barr | 415/36 |
| 3,128,989 | 4/1964 | Allingham | 415/156 X |
| 3,352,536 | 11/1967 | Almquist | 415/36 |
| 3,733,143 | 5/1973 | Theis | 415/141 X |
| 3,856,432 | 12/1974 | Campagnuolo et al. | 416/45 |
| 4,161,371 | 7/1979 | Sheppa | 416/43 |

FOREIGN PATENT DOCUMENTS

| | | | |
|---|---|---|---|
| 207674 | 8/1956 | Australia | 415/36 |
| 280189 | 11/1914 | Fed. Rep. of Germany | 416/186 A |
| 126707 | 5/1919 | United Kingdom | 415/36 |

*Primary Examiner*—Everette A. Powell, Jr.

*Attorney, Agent, or Firm*—Finnegan, Henderson, Farabow, Garrett & Dunner

[57] ABSTRACT

A cup shaped disc (13) consisting of a central portion (20) having radially extending blades (18) is attached with its central portion to the protruding hub portion (12) of a radial flow turbine wheel (2) consisting of a backing plate (10) extending transversely to its rotational axis (7) and having axially protruding turbine blades (11) in addition to the protruding hub. At high rotational speeds this disc (13) will tend to straighten out, whereby the effective portion of the turbine blades will be reduced and the increase in the rotational speed restricted. This is of importance in ram air turbines for missiles.

8 Claims, 4 Drawing Figures

RAM AIR TURBINES

BACKGROUND OF THE INVENTION

1. Field of the Invention

The present invention relates to a ram air turbine for driving an electric generator in a missile, the turbine including a turbine wheel to which ram air is supplied.

A typical characteristic of ballistic missiles is that the velocity along the trajectory may vary greatly depending on the firing angle. Additionally, in certain types of missiles there is a variation in velocity because of a corresponding variation in the discharge velocity of the missile. Thus, the total variation in velocity for such types of missiles may be rather large.

When using ram air turbine driven generators for continuous supply of electric power in such missiles the said variation in missile velocity may constitute a problem, especially when the ratio between the highest and lowest velocity is greater than 4:1 and the maximum velocity is high. It may for instance be desirable to obtain satisfactory rotational speeds of the turbine at missile speeds in the range from 150 to 1.000 m/s. On one hand it is desirable to obtain at the lowest missile velocity an electric power supply which is sufficient for the electric circuits in the missile to function. On the other hand it is desirable to avoid extremely high turbine speeds which may occur at the highest missile speed, since such turbine speeds make heavy demands on the turbine and the generator.

It is therefore desirable for the turbine to reach a certain minimum speed of rotation as soon as possible after launching without the speed of rotation becoming too high at the hihest missile speeds.

2. The Prior Art

Various methods have been suggested in order to solve this problem. Reference is made to U.S. Pat. Nos. 2,701,526, 2,804,824 and 4,161,371, as well as to U.S. Pat. No. 4,267,775, in which the two first mentioned U.S. patent specifications are discussed.

The invention according to U.S. Pat. No. 4,267,775 solves the problem to a large extent without resorting to movable parts, the flow of air being controlled in such a way that the rotational speed will not be too high. However, in cases when an even greater control is desirable it has turned out that solutions are required which are based on movable parts.

SUMMARY OF THE INVENTION

According to the invention the turbine wheel includes means which is actuated by centrifugal force, said means upon an increase in the rotational speed of the turbine wheel restricting the cross section of the flow passage through the turbine wheel and thus the amount of ram air acting on the blades of the turbine wheel.

The centrifugal force actuated means preferably comprises a disc of inverted cup shape, the central portion of which is attached to a protruding hub on the front of a radial turbine wheel, said disc being manufactured from a resilient material which upon rotation of the turbine wheel allows straightening out of the cup shaped disc due to centrifugal forces, whereby the outer edges of the disc will lift from the turbine wheel.

In order to increase the capacity of the disc to deform, its radially outer portion may be divided by radial slots into separate blades. These slots do not extend all the way to the center of the disc, and the blades are thus mutually integral through the central portion of the disc.

The slots are preferably formed in a flat disc which is subsequently shaped into a cup, whereby the lateral edges of the blades will be induced to overlap.

BRIEF DESCRIPTION OF THE DRAWINGS

Further features and advantages of the invention will be apparent from the following specification, reference being had to the drawing.

DETAILED DESCRIPTION

Figure 1:
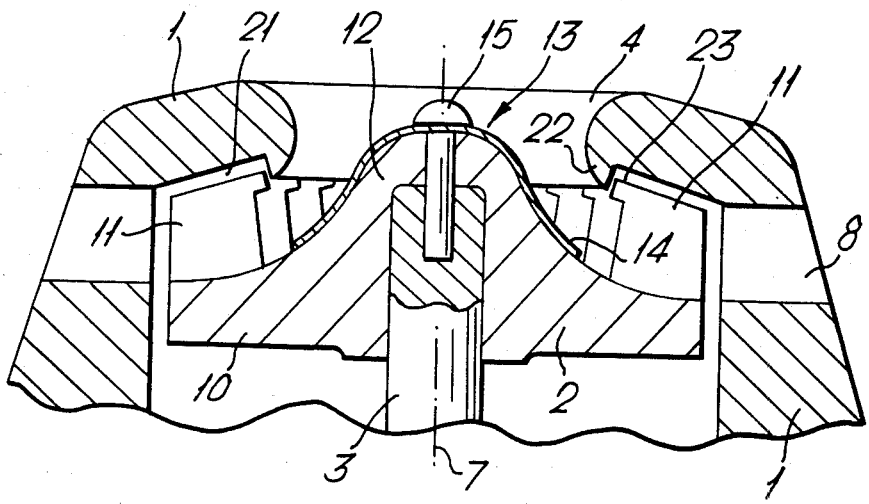
FIG. 1 is an axial section through the nose portion of a missile, the disc according to the invention being shown in the position which it occupies when the turbine wheel is not rotating.

The nose portion 1 of the missile shown in the drawing consists of an outer shell or a housing surrounding a ram air driven turbine wheel 2. The turbine wheel 2 drives an electric generator which will not be further described, since it is of conventional design and thus without significance for the invention.

In the nose portion 1 of the missile there is provided an axial inlet opening or duct 4 for ram air. The ram air is passed through the inlet opening 4 to the radial flow turbine wheel 2 and discharged through radial outlet ducts 8.

It will be seen that the turbine wheel consists of a backing plate 10 extending transversely to the axis 7 of rotation and carrying axially protruding blades 11 and a hub 12 on the front, i.e. the side facing the supplied ram air.

According to the present invention the rotating turbine wheel 2 includes means which is actuated by centrifugal force and takes the form of a disc 13 of inverted cup shape. This disc serves to restrict the cross section of the flow passage through the turbine wheel 2 and thus the amount of ram air acting on the blades 11 of the turbine wheel when the rotational speed of the turbine wheel increases. This effect is obtained due to the fact that the disc 12 is manufactured from a thin, resilient material which upon rotation of the turbine wheel allows straightening out of the cup shaped disc 13 due to centrifugal forces, whereby the outer edges 14 of the disc will lift from the backing plate 10. The central portion of the cup shaped disc is attached to the hub 12, such as by means of the head 15 of a rivet or bolt also securing the turbine wheel 2 to the turbine shaft 3.

In operation the disc 13 will thus rotate together with the turbine wheel 2. As the rotational speed of the turbine is increased, the increasing centrifugal force will cause the disc 13 to tend to straighten out into a flat disc lying in a plane of the attached central portion. The degree of straightening out will of course depend on the mechanical properties of the material in the disc 13. The material must stand the relatively high forces and the appurtenant deformation and must also be elastic at the forces to which the disc is subjected, so that the disc returns to its original position when the rotational speed is reduced. Spring steel is a suitable material for the disc.

Figure 2:
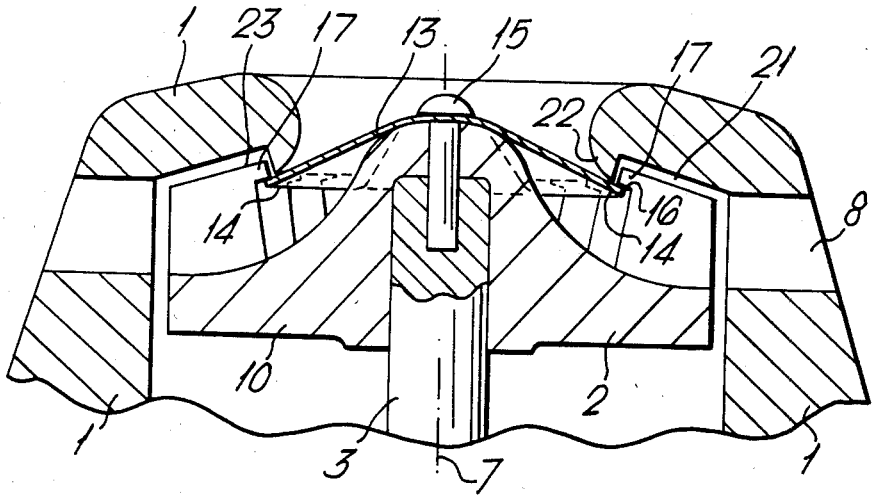
FIG. 2 is an axial section corresponding to FIG. 1, the disc according to the invention being shown in the position adopted when the turbine wheel is operating at approximately the maximum rotational speed.

FIG. 2 indicates the shape of the disc 13 at the maximum rotational speed, the radial outer edges 14 of the disc then abutting stops 16 formed by the lower side of radially inwardly directed protrusions 17 on the blades 11.

It will be understood that as the disc 13 straightens out it will direct some of the ram air away from the blades of the turbine wheel, whereby the rotational speed of the turbine wheel will not increase to the same extent as if the disc 13 has not been present.

Figure 3:
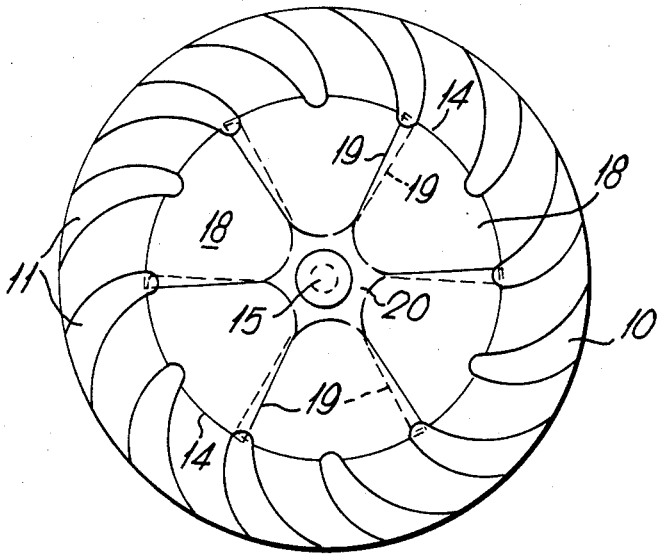
FIG. 3 is a front view of the turbine wheel with the disc according to the invention in the position shown in FIG. 2.

In order to obtain the desired ratio between strength and elastic deformation it is convenient to divide the radially outer portion of the disc into separate blades 18 by means of radial slots formed in a flat disc which is subsequently shaped into a cup, whereby the lateral edges 19 of the blades will be induced to overlap, as best illustrated in FIG. 3. From this figure it is also clear that the blades 18 are mutually integral through the central portion 20 of the disc. The deformation of the flat disc into cup shape is carried out in such a manner that the lateral edges 19 of each blade will lie above one adjacent blade and below the other, respectively. This secures that the blades will remain in a "locking" engagement with each other and will therefore lift to the same extent. The restriction of the straightening out of the blades by the stops 16 secures the maintenance of the overlapping of the blades in all positions, whereby the blades back each other and are prevented from adopting a "reversed" position in operation, for instance because of unintentional variations in the quality of the material in the disc.

It will be understood that a further centrifugal load may be applied to the blades, for instance by making the blades thicker at their outer end or providing them with a weight in some other manner. Furthermore, it will be possible to obtain an aerodynamic lift on the blades by twisting them in a suitable manner.

Between the blades 11 on the front of the turbine wheel and the nose portion 1 there must be a clearance 21. In the embodiment which is diagrammatically indicated in the drawing, it will be seen that this clearance 21 is covered by a skirt 22 which from the axially inner edge of the nose portion 1 surrounding the inlet passage 4 extends axially past the front edge 23 of the blades 11 radially inside thereof. This skirt 22 will cover the inlet to the clearance gap 21, whereby the loss resulting from this clearance at low speeds will be reduced, the skirt at the same time reducing the passage between the disc 13 and the nose portion 1 at high speeds, thereby reducing the maximal speed of the turbine wheel.

Figure 4:
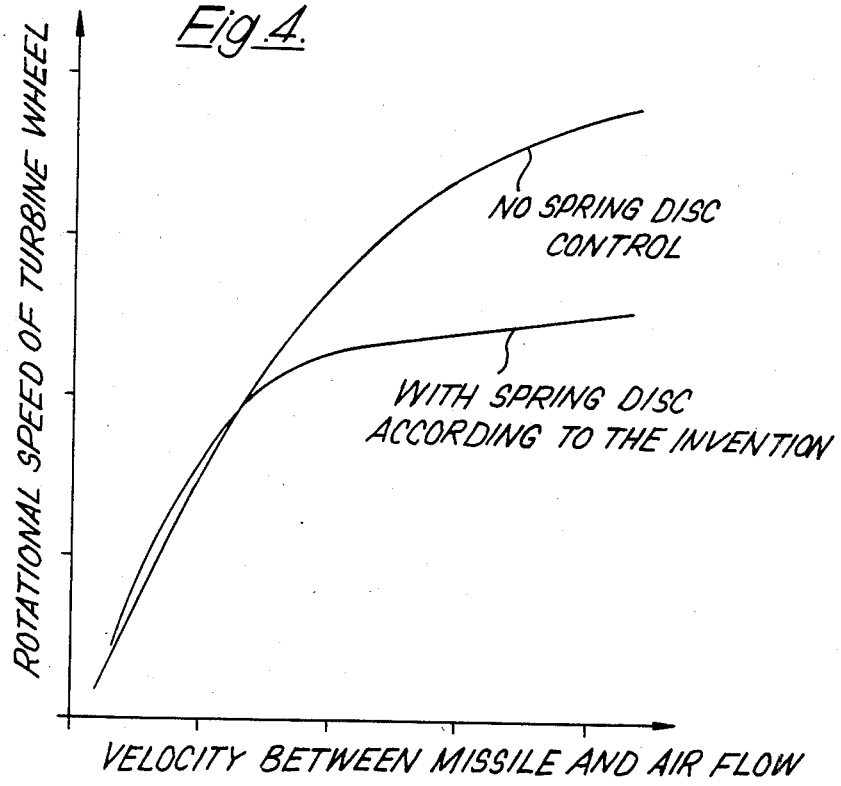
FIG. 4 is a diagrammatic representation of wind tunnel test results on missiles with and without a spring disc according to the invention.

The test results from a wind tunnel experiment illustrated in FIG. 4 show that in the lower range of relative speed between missile and air flow the turbine speed of a turbine having a disc 13 according to the invention is practically the same as for a turbine wheel without such a disc. At higher speeds the turbine speed increases substantially slower than for a turbine wheel having no spring disc. It must therefore be presumed that the turbine speed at maximum missile velocity will be substantially lower than without the spring disc, whereby the safety against ruining of the turbine bearings is substantially increased.

What I claim is:

1. A ram air turbine for driving an electric generator in a missile, the turbine comprising a turbine housing having a flow passage for ducting the incoming ram air, a turbine wheel having blades to which the ram air is supplied from said flow passage, wherein the turbine wheel includes means actuated by centrifugal force upon an increase in the rotational speed of the turbine sheel for uniformly restricting the cross section of the flow passage to all of said turbine blades and thus the amount of ram air acting on the blades of the turbine wheel to an extent depending upon the rotational speed of the turbine wheel, wherein the turbine wheel is a radial turbine wheel having a protruding central hub portion and the incoming ram air is incident upon the turbine wheel along the axial direction and thereafter flows past the blades in a radial direction, and wherein the centrifugal force actuated means comprises a disc of cup shape and inverted relative to the axial direction of the incoming ram air, the central portion of said disc being attached to said protruding hub of said radial turbine wheel, said disc being manufactured from a resilient material which upon rotation of the turbine wheel allows straightening-out deflection of the cup-shaped disc due to centrifugal forces, the outer edges of the disc lifting from an undeflected position against the turbine wheel.

2. A ram air turbine according to claim 1, wherein the radially outer portion of said disc is divided by radial slots into separate blades, -sections the turbine further comprising interengaging means for providing conforming movement of said separate blade-sections, whereby each blade-section is deflected to essentially the same degree at a given turbine wheel speed.

3. A ram air turbine according to claim 2, wherein said interengaging means includes said blade-sections being sized to overlap adjacent blade sections for the entire range of straightening-out deflection.

4. A ram air turbine according to claim 3, wherein the disc has outwardly bent outer edges and thus a cup shape similar to a lily flower, and in which the lateral edges of each blade-section lie above one adjacent blade-section and below the other, respectively, in a repeating pattern about the periphery of said disc.

5. A ram air turbine according to any one of the claims 2 to 4, wherein said disc is made from spring steel.

6. A ram air turbine according to any of the claims 1 to 5, further including stops for restricting the extent of straightening-out deflection of the disc.

7. A ram air turbine according to claim 6, wherein the turbine blades have inwardly directed radial protrusions, and wherein the outer edge of the disc extends below said inwardly directed protrusions of the turbine blades, so that the lower side of the protrusions form said stops for limiting the straightening-out deflection of the disc at high rotational speeds.

8. A ram air turbine according to claim 7, wherein a running clearance is provided between the turbine blades and said housing, said housing including said turbine housing including an annular skirt surrounding said flow passage and extending radially inside the protrusions to block the flow of ram air into the running clearance.

* * * * *